US007638945B2

(12) United States Patent
Takata

(10) Patent No.: US 7,638,945 B2
(45) Date of Patent: Dec. 29, 2009

(54) COLD CATHODE TUBE LAMP WITH AN EXTERNAL ELECTRODE CAPACITIVELY COUPLED TO A MOUNTING MEMBER, LIGHTING DEVICE, AND DISPLAY DEVICE

(75) Inventor: Yoshiki Takata, Suzuka (JP)

(73) Assignee: Sharp Kabushiki Kaisha, Osaka (JP)

( * ) Notice: Subject to any disclaimer, the term of this patent is extended or adjusted under 35 U.S.C. 154(b) by 582 days.

(21) Appl. No.: 11/380,742

(22) Filed: Apr. 28, 2006

(65) Prior Publication Data

US 2006/0197424 A1 Sep. 7, 2006

Related U.S. Application Data

(63) Continuation-in-part of application No. PCT/JP2005/019875, filed on Oct. 28, 2005.

(30) Foreign Application Priority Data

Jan. 7, 2005 (JP) ..... 2005-002040

(51) Int. Cl.
*H01J 65/00* (2006.01)

(52) U.S. Cl. ..... 313/607; 313/268

(58) Field of Classification Search ..... 313/234, 313/484–494, 581, 582, 594, 422, 634, 607, 313/514, 515, 519, 633, 631, 483, 475, 473, 313/56, 169.4
See application file for complete search history.

(56) References Cited

U.S. PATENT DOCUMENTS 4,912,368 A 3/1990 Nishiyama et al.
5,387,837 A 2/1995 Roelevink et al.
5,705,879 A 1/1998 Abe et al.
2003/0214478 A1 11/2003 Yoo et al.

FOREIGN PATENT DOCUMENTS

EP 1 429 585 A1 6/2005
JP 64-082452 A 3/1989

(Continued)

OTHER PUBLICATIONS

International Search Report issued in the corresponding International Application No. PCT/JP2005/019875 mailed on Dec. 6, 2005.

(Continued)

*Primary Examiner*—Peter Macchiarolo
(74) *Attorney, Agent, or Firm*—Keating & Bennett, LLP

(57) ABSTRACT

A cold cathode tube lamp is fed with power from a first conductive member and a second conductive member provided outside in a mounted state, and includes a glass tube, first and second internal electrodes provided inside the glass tube, a first external electrode provided outside the glass tube and connected to the first internal electrode, a second external electrode provided outside the glass tube and connected to the second internal electrode, a first insulating layer coated on the first external electrode, and a second insulating layer coated on the second external electrode. In a mounted state, the first conductive member and the first external electrode are capacitively coupled together, and the second conductive member and the second external electrode are capacitively coupled together. With such a structure, parallel lighting can be achieved by parallel driving.

18 Claims, 13 Drawing Sheets

FOREIGN PATENT DOCUMENTS

| | | | |
|---|---|---|---|
| JP | 02-41362 | U | 3/1990 |
| JP | 3-187151 | A | 8/1991 |
| JP | 05-121049 | A | 5/1993 |
| JP | 06-084499 | A | 3/1994 |
| JP | 07-220888 | A | 8/1995 |
| JP | 11-040109 | A | 2/1999 |
| JP | 2003-100482 | A | 4/2003 |
| JP | 2004-031338 | A | 1/2004 |
| JP | 2004-039264 | A | 2/2004 |
| JP | 2004-039336 | A | 2/2004 |

OTHER PUBLICATIONS

Official communication issued in a counterpart Japanese Application No. 2006-544110, mailed on Aug. 28, 2007.

COLD CATHODE TUBE LAMP WITH AN EXTERNAL ELECTRODE CAPACITIVELY COUPLED TO A MOUNTING MEMBER, LIGHTING DEVICE, AND DISPLAY DEVICE

BACKGROUND OF THE INVENTION

1. Field of the Invention

The present invention relates to a cold cathode tube lamp.

2. Description of the Related Art

FIG. 21 is a schematic sectional view of a conventional cold cathode tube lamp. The conventional cold cathode tube lamp shown in FIG. 21 has internal electrodes 2 and 3 inside a glass tube 1. A portion of the internal electrodes 2 and 3 penetrate through the glass tube 1 to protrude outside the glass tube 1, functioning as electrode terminals. In the structure described above, the inside of the glass tube 1 is sealed. A fluorescent substance is applied to the inner wall of the glass tube 1. Into the sealed glass tube 1, in order that the overall pressure inside the glass tube 1 may become $10.7\times10^3$ to $5.3\times10^3$ Pa (≈80 to 40 Torr), neon and argon are typically sealed with a ratio of 95 to 5, 80 to 20, or the like, and further several milligrams of mercury is enclosed. Note that, instead of mercury, xenon may be enclosed.

When the lamp voltage, i.e., voltage between the internal electrodes, reaches a discharge start voltage VS, discharge starts, whereby mercury and xenon generate ultraviolet rays which causes a fluorescent substance applied to the inner wall of the glass tube 1 to illuminate.

The conventional cold cathode tube lamp shown in FIG. 21 has an equivalent circuit thereof serving as a resistance whose resistance value decreases nonlinearly in accordance with an increase in current, and has a nonlinear negative impedance characteristic like a V-I characteristic shown in FIG. 22 (for example, see JP-A-H7-220888 (FIG. 4)).

As one of the applications of the conventional cold cathode tube lamp shown in FIG. 21, there is a backlight for a liquid crystal display device. When the display screen of the liquid crystal display device is large, a plurality of cold cathode tube lamps is provided in an array. In this case, if a plurality of cold cathode tube lamps can be driven in parallel, only one power supply device can be provided since the same voltage is applied to all the cold cathode tube lamps.

Now, driving a plurality of (for example, three) cold cathode tube lamps in parallel will be discussed. There is a variation in the V-I characteristic among the individual cold cathode tube lamps. The V-I characteristic lines T1 to T3 of the first to third cold cathode tube lamps, respectively, are V-I characteristics shown in FIG. 23. The same alternating voltage is applied to the first to third cold cathode tube lamps, and this alternating voltage is boosted. As a result of boosting, when the alternating voltage reaches a discharge start voltage VS1 of the first cold cathode tube lamp, the first cold cathode tube lamp lights up, and a voltage across the first cold cathode tube lamp decreases due to the nonlinear negative impedance characteristic. The voltage across the second cold cathode tube lamp and the voltage across of the third cold cathode tube lamp agrees with the voltage across the first cold cathode tube lamp; therefore, the aforementioned alternating voltage never reaches a discharge start voltageVS2 of the second cold cathode tube lamp and a discharge start voltageVS3 of the third cold cathode tube lamp. That is, when a plurality of cold cathode tube lamps are simply driven in parallel, only one of the cold cathode tube lamps can be lit up. Therefore, a structure is typically adopted in which a power supply circuit is provided for each cold cathode tube lamp to light up a plurality of cold cathode tube lamps. However, with this structure, the same number of power supply circuits as that of cold cathode tube lamps is required, thus resulting in high costs. This is disadvantageous in terms of reduction in size, weight and cost. Moreover, each cold cathode tube lamp is typically connected to a power supply circuit via a harness (also called a lead wire) and a connector. Thus, this involves much labor in fitting the cold cathode tube lamp, thus resulting in deteriorated assembly efficiency with a lighting device or the like using the cold cathode tube lamp, and also involves much labor in detaching the cold cathode tube lamp. This results in decreased replacement efficiency upon replacement of the cold cathode tube lamp and deteriorated dismantling efficiency upon disposing a lighting device or the like using the cold cathode tube lamp.

As a lamp capable of solving such a problem, an external electrode fluorescent lamp (EEFL) has been developed (for example, see JP-A-2004-31338 and JP-A-2004-39264). FIG. 24 is a schematic sectional view of the external electrode fluorescent lamp. In FIG. 24, portions which are the same as those in FIG. 21 are provided with the same numerals and thus omitted from the detailed description. The external electrode fluorescent lamp shown in FIG. 24 is prepared by removing the internal electrodes 2 and 3 from the conventional cold cathode tube lamp shown in FIG. 21 and forming external electrodes 4 and 5 at end portions of the glass tube 1. In the structure described above, the inside of the glass tube 1 is sealed.

In the external electrode fluorescent lamp shown in FIG. 24, when the lamp voltage, i.e., voltage between the external electrodes, reaches a discharge start voltage VS', discharge starts, whereby mercury and xenon generate ultraviolet rays which cause a fluorescent substance applied to the inner wall of the glass tube 1 to illuminate.

The inside of the glass tube 1 has a nonlinear negative impedance characteristic, and the external electrodes and the inside of the glass tube 1 are insulated from each other by glass. Thus, the external electrode fluorescent lamp shown in FIG. 24 has an equivalent circuit thereof serving as a serial connected body in which a capacitor is connected to both ends of a resistance whose resistance value decreases nonlinearly in accordance with an increase in current. Therefore, the external electrode fluorescent lamp as a whole has a nonlinear positive impedance characteristic like a V-I characteristic shown in FIG. 25.

Now, driving a plurality of (for example, three) external electrode fluorescent lamps in parallel will be discussed. There is a variation in the V-I characteristic among the individual external electrode fluorescent lamps. The V-I characteristic lines T1' to T3' of the first to third external electrode fluorescent lamps, respectively, are V-I characteristics shown in FIG. 26. The same alternating voltage is applied to the first to third external electrode fluorescent lamps, and this alternating voltage is boosted. As a result of boosting, when the alternating voltage reaches a discharge start voltage VS1' of the first external electrode fluorescent lamp, the first external electrode fluorescent lamp lights up. Then, the alternating voltage described above increases with an increase in the output from the power supply device. Then, when the alternating voltage reaches a discharge start voltage VS2' of the second external electrode fluorescent lamp, the second external electrode fluorescent lamp lights up, and when the alternating voltage reaches a discharge start voltage VS3' of the third external electrode fluorescent lamp, the third external electrode fluorescent lamp lights up. That is, even when a plurality of external electrode fluorescent lamps are simply driven in parallel, all the plurality of external electrode fluorescent lamps can be lit up.

Due to the arrangement of the external electrodes on the outer circumference of the glass tube, in a lighting device or the like using an external electrode fluorescent lamp, a holding jig formed of a resilient metal member (for example, spring steel) clips the external electrode of the external electrode fluorescent lamp under the influence of its resilient characteristic, so that a power can be supplied to the external electrode fluorescent lamp via the holding jig. Such a method provides an advantage that the external electrode fluorescent lamp can be fitted and detached easily.

However, in the external electrode fluorescent lamp, the glass lying between the external electrode and the inner space of the glass tube corresponds to a dielectric body that is clipped by an electrode of a capacitor as one component of an equivalent circuit of the external electrode fluorescent lamp. Thus, charged particles hit against the inner wall of the glass tube opposing the external electrode, so that the inner wall of the glass tube is locally subjected to spattering. Then, once the inner wall of the glass tube is subjected to spattering, the electrostatic capacitance of the portion subjected to this spattering increases. Thus, the charged particles intensively hit the portion subjected to this spattering and a pin hole finally opens, and then the sealing condition inside the glass tube can no longer be maintained. Thus, the external electrode fluorescent lamp has been suffering from a problem with reliability.

SUMMARY OF THE INVENTION

In order to solve the problems described above, preferred embodiments of the present invention provide a cold cathode tube lamp that is capable of being lit up in parallel by being driven in parallel and a lighting device for a display device and a display device including the same.

According to a preferred embodiment of the present invention, a cold cathode tube lamp is fed with power from a first conductive member and a second conductive member provided outside in a mounted state. The cold cathode tube lamp is so structured (hereinafter referred to as a first structure) as to include: an insulating tube formed of an insulating material that passes light (the light may be partially blocked or may be partially or entirely attenuated as long as the light can be passed to such a degree so as to function as a lamp), a first internal electrode provided inside the insulating tube, a second internal electrode provided inside the insulating tube, and a first external electrode provided outside the insulating tube and connected to the first internal electrode so as to be provided with the same potential as the potential of the first internal electrode, in which the first conductive member and the first external electrode are capacitively coupled together in a mounted state. Examples of the insulating tube formed of an insulating material that passes light include a glass tube, a resin tube, and the like. Examples of methods of connecting together the internal electrode and the external electrode include: for example, a method in which a portion of the internal electrode penetrates through the insulating tube and then projects to the inside and outside thereof to be connected to the external electrode; a method in which a portion of the external electrode penetrates through the insulating tube and then projects to the inside of the insulating tube to be connected to the internal electrode; a method in which the conductive member penetrates through the insulating tube and then projects to the inside and outside of the insulating tube to be connected to the internal electrode and the external electrode; and the like. In any of the methods described above, the insulating tube is sealed.

According to such a structure, a circuit composed of the cold cathode tube lamp, the first conductive member, and the second conductive member having the first structure has a equivalent circuit thereof serving as a serially connected body in which a capacitor (hereinafter also referred to as a ballast capacitor) is connected to at least one end of a resistance whose resistance value nonlinearly decreases in accordance with an increase in current, and thus has a nonlinear positive impedance characteristic. Therefore, the cold cathode tube lamps having the first structure can be lit up in parallel by being driven in parallel.

The cold cathode tube lamp having the first structure may be so structured (hereinafter referred to as a second structure) as to include a second external electrode provided outside the insulating tube and connected to the second internal electrode so as to be provided with the same potential as the potential of the second internal electrode, in which the second conductive member and the second external electrode are capacitively coupled together in a mounted state.

According to such a structure, a circuit composed of the cold cathode tube lamp having the first structure, the first conductive member, and the second conductive member has a equivalent circuit thereof serving as a serially connected body in which a ballast capacitor is connected to both ends of a resistance whose resistance value nonlinearly decreases in accordance with an increase in current, and the circuit has a nonlinear positive impedance characteristic. Therefore, the cold cathode tube lamps having the second structure can be lit up in parallel by being driven in parallel.

In the cold cathode tube lamp having the first structure, a first insulator is preferably further provided and is located between the first conductive member and the first external electrode in a mounted state.

According to such a structure, the cold cathode tube lamp and the first conductive member having the third structure can directly contact each other. Therefore, the first conductive member can be used as the holding jig of the cold cathode tube lamp having the third structure. In addition, the electrostatic capacitance of the ballast capacitor can be increased such that a nonlinear positive impedance characteristic can easily be provided.

The cold cathode tube lamp having the second structure may be so structured (hereinafter referred to as a fourth structure) as to include a first insulator located between the first conductive member and the first external electrode in a mounted state, and a second insulator located between the second conductive member and the second external electrode in a mounted state.

According to such a structure, the cold cathode tube lamp having the fourth structure, the first conductive member, and the second conductive member can directly contact one another. Therefore, the first conductive member and the second conductive member can be used as the holding jigs of the cold cathode tube lamp having the fourth structure. In addition, the electrostatic capacitance of the ballast capacitor can be increased such that a nonlinear positive impedance characteristic can easily be provided.

The cold cathode tube lamp having the third structure described above may be structured (hereinafter referred to as a fifth structure) so that the entire first external electrode is covered by the insulating tube and the first insulator.

According to such a structure, creeping discharge at an edge portion of the first external electrode can be prevented, thereby improving the voltage resistance.

The cold cathode tube lamp having the fourth structure may be structured (hereinafter referred to as a sixth structure) so that the entire first external electrode is covered by the insulating tube and the first insulator and so that the entire second external electrode is covered by the insulating tube and the second insulator.

According to such a structure, creeping discharge at edge portions of the first external electrode and the second external electrode can be prevented, thereby improving voltage resistance.

To overcome the problems described above and provide the above-noted advantages, a lighting device for a display device according to another preferred embodiment of the present invention is so structured (hereinafter referred to as a seventh structure) as to include the cold cathode tube lamp having the first structure described above, a first conductive member, a second conductive member, a third insulator located between the first conductive member and the cold cathode tube lamp in a mounted state, and a power supply device that supplies power to the cold cathode tube lamp through the first conductive member, the second conductive member, and the third insulator.

According to such a structure, a circuit composed of the cold cathode tube lamp having the first structure, the first conductive member, and the second conductive member has a equivalent circuit thereof serving as a serially connected body in which a capacitor (hereinafter referred to as a ballast capacitor) is connected to at least one end of a resistance whose resistance value nonlinearly decreases in accordance with an increase in current, and the circuit has a nonlinear positive impedance characteristic. Therefore, the cold cathode tube lamps having the first structure can be lit up in parallel by being driven in parallel.

To overcome the problems described above and provide the above-noted advantages, a lighting device for a display device according to another preferred embodiment of the present invention is so structured (hereinafter referred to as an eighth structure) as to include the cold cathode tube lamp having the second structure described above, a first conductive member, a second conductive member, a third insulator located between the first conductive member and the cold cathode tube lamp in a mounted state, a fourth insulator located between the second conductive member and the cold cathode tube lamp in a mounted state, and a power supply device that supplies power to the cold cathode tube lamp through the first conductive member, the second conductive member, the third insulator, and the fourth insulator.

According to such a structure, a circuit composed of the cold cathode tube lamp having the second structure, the first conductive member, and the second conductive member has a equivalent circuit thereof serving as a serially connected body in which a ballast capacitor is connected to both ends of a resistance whose resistance value nonlinearly decreases in accordance with an increase in current, and the circuit has a nonlinear positive impedance characteristic. Therefore, the cold cathode tube lamps with the second structure can be lit up in parallel by being driven in parallel.

To overcome the problems described above and provide the above-noted advantages, a lighting device for a display device according to another preferred embodiment of the present invention is so structured (hereinafter referred to as a ninth structure) to include the cold cathode tube lamp having any of the third to sixth structures, a first conductive member, a second conductive member, and a power supply device that supplies power to the cold cathode tube lamp through the first conductive member and the second conductive member.

According to such a structure, when the cold cathode tube lamp having the third or fifth structure is used, the cold cathode tube lamp having the third or fifth structure and the first conductive member can directly contact each other. Therefore, the first conductive member can be used as the holding jig of the cold cathode tube lamp with the third or fifth structure. When the cold cathode tube lamp with the fourth or sixth structure is used, the cold cathode tube lamp with the fourth or sixth structure, the first conductive member, and the second conductive member can directly contact one another. As a result, the first conductive member and the second conductive member can be used as the holding jigs of the cold cathode tube lamp having the fourth or sixth structure. In addition, the electrostatic capacitance of the ballast capacitor can be increased such that a nonlinear positive impedance characteristic can easily be provided.

To overcome the problems described above and provide the above-noted advantages, a lighting device for a display device according to another preferred embodiment of the present invention is so structured (hereinafter referred to as a tenth structure) to include the cold cathode tube lamp having either of the third and fifth structures, a first conductive member, a second conductive member, a third insulator located between the first conductive member and the cold cathode tube lamp in a mounted state, and a power supply device that supplies power to the cold cathode tube lamp through the first conductive member, the second conductive member, and the third insulator.

According to such a structure, the first conductive member can be used as the holding jig of the cold cathode tube lamp having the third or fifth structure. In addition, the electrostatic capacitance of the ballast capacitor can be increased such that a nonlinear positive impedance characteristic can easily be provided. Further, the insulators are provided on both the first conductive member side and the first external electrode side of the cold cathode tube lamp having the third or fifth structure, thereby improving the reliability in the voltage resistance.

To overcome the problems described above and provide the above-noted advantages, a lighting device for a display device according to another preferred embodiment of the present invention is so structured (hereinafter referred to as an eleventh structure) to include the cold cathode tube lamp having either of the fourth and sixth structures, a first conductive member, a second conductive member, a third insulator located between the first conductive member and the cold cathode tube lamp in a mounted state, a fourth insulator located between the second conductive member and the cold cathode tube lamp in a mounted state, and a power supply device that supplies power to the cold cathode tube lamp through the first conductive member, the second conductive member, the third insulator, and the fourth insulator.

According to such a structure, the first conductive member and the second conductive member can be used as the holding jigs of the cold cathode tube lamp having the fourth or sixth structure. In addition, the electrostatic capacitance of the ballast capacitor can be increased such that a nonlinear positive impedance characteristic can easily be provided. Further, the insulators are provided on the first conductive member side, the second conductive member side, and on both the first and second external electrode sides of the cold cathode tube lamp having the fourth or sixth structure, thereby improving the reliability in the voltage resistance.

The lighting device for a display device having the seventh or tenth structure described above may be structured (hereinafter referred to as a twelfth structure) so that the third insulator is provided on the entire surface of the first conductive member excluding the exposed portion required for connection to the power supply device.

According to such a structure, discharge between the first external electrode and the first conductive member can be prevented, thereby improving the voltage resistance.

The lighting device for a display device having the eighth or eleventh structure described above may be structured (hereinafter referred to as a thirteenth structure) so that the third insulator is provided on the entire surface of the first conductive member excluding the exposed portion required for connection to the power supply device and also so that the fourth insulator is provided on the entire surface of the second conductive member excluding the exposed portion required for connection to the power supply device.

According to such a structure, discharge between the first external electrode and the first conductive member and also between the second external electrode and the second conductive member can be prevented, thereby improving the voltage resistance.

To achieve the advantages described above, another preferred embodiment of the present invention provides a cold cathode tube lamp that is fed with power from a first conductive member and a second conductive member provided outside in a mounted state. The cold cathode tube lamp is so structured (hereinafter referred to as a fourteenth structure) as to include: an insulating tube formed of an insulating material that passes light (the light may be partially blocked or may be partially or entirely attenuated as long as the light can be passed to such a degree as to function as a lamp), a first internal electrode provided inside the insulating tube, a second internal electrode provided inside the insulating tube, a first external electrode provided outside the insulating tube and connected to the first internal electrode so as to be provided with the same potential as the potential of the first internal electrode, a first insulator, and a first opposite electrode opposing the first external electrode via the first insulator, in which the first conductive member and the first opposite electrode are electrically connected together in a mounted state. Examples of the insulating tube formed of an insulating material that passes light include a glass tube, a resin tube, and the like. Examples of methods of connecting together the internal electrode and the external electrode include: for example, a method in which a portion of the internal electrode penetrates through the insulating tube and then projects to the outside thereof to be connected to the external electrode; a method in which a portion of the external electrode penetrates through the insulating tube and then projects to the inside of the insulating tube to be connected to the internal electrode; a method in which the conductive member penetrates through the insulating tube and then projects to the inside and outside of the insulating tube to be connected to the internal electrode and the external electrode; and the like. In any of the methods described above, the insulating tube is sealed.

According to such a structure, a circuit composed of the cold cathode tube lamp having the fourteenth structure has an equivalent circuit thereof serving as a serially connected body in which a capacitor (hereinafter also referred to as a ballast capacitor) is connected to at least one end of a resistance whose resistance value nonlinearly decreases in accordance with an increase in current, and the circuit has a nonlinear positive impedance characteristic. Therefore, the cold cathode tube lamps having the fourteenth structure can be lit up in parallel by being driven in parallel. Moreover, the first opposite electrode is fixed in position with respect to the first external electrode, thereby permitting stabilization of a capacitor defined by the first external electrode and the first opposite electrode.

The cold cathode tube lamp having the fourteenth structure described above may be so structured (hereinafter referred to as a fifteenth structure) as to include a second external electrode provided outside the insulating tube and connected to the second internal electrode so as to be provided with the same potential as the potential of the second internal electrode, a second insulator, and a second opposite electrode opposing the second external electrode via the second insulator, in which the second conductive member and the second external electrode are electrically connected together in a mounted state.

According to such a structure, a circuit composed of the cold cathode tube lamp having the fifteenth structure has a equivalent circuit thereof serving as a serially connected body in which a capacitor (hereinafter also referred to as ballast capacitor) is connected to both ends of a resistance whose resistance value nonlinearly decreases in accordance with an increase in current, and the circuit has a nonlinear positive impedance characteristic. Therefore, the cold cathode tube lamps having the fifteenth structure can be lit up in parallel by being driven in parallel. Moreover, the first opposite electrode is fixed in position with respect to the first external electrode and the second opposite electrode is fixed in position with respect to the second external electrode, thereby permitting stabilization of a capacitor defined by the first external electrode and the first opposite electrode and a capacitor defined by the second external electrode and the second opposite electrode.

The cold cathode tube lamp having the fourteenth structure may be structured (hereinafter referred to as a sixteenth structure) so that the entire first external electrode is covered by the insulating tube and the first insulator.

According to such a structure, creeping discharge at an edge portion of the first external electrode can be prevented, thereby improving the voltage resistance.

The cold cathode tube lamp having the fifteenth structure may be structured (hereinafter referred to as a seventeenth structure) so that the entire first external electrode is covered by the insulating tube and the first insulator and so that the entire second external electrode is covered by the insulating tube and the second insulator.

According to such a structure, creeping discharge at edge portions of the first external electrode and the second external electrode can be prevented, thereby improving the voltage resistance.

The cold cathode tube lamp having the fourteenth or sixteenth structure as described above may be structured (hereinafter referred to as an eighteenth structure) so that the first opposite electrode has a projection and so that the first conductive member and the projection of the first opposite electrode are electrically connected together in a mounted state.

According to such a structure, the electrical connection between the first conductive member and the projection of the first opposite electrode in a mounted state can be ensured.

The cold cathode tube lamp having the fifteenth or seventeenth structure as described above may be structured (hereinafter referred to as a nineteenth structure) so that the first opposite electrode has a projection, so that the first conductive member and the projection of the first opposite electrode are electrically connected together in a mounted state, so that the second opposite electrode has a projection, and so that the second conductive member and the projection of the second opposite electrode are electrically connected together in a mounted state.

According to such a structure, the electrical connection between the first conductive member and the projection of the first opposite electrode and the electrical connection between the second conductive member and the projection of the second opposite electrode, both in a mounted state, can be ensured.

To achieve the advantages described above, a lighting device for a display device is so structured (hereinafter referred to as a twentieth structure) as to include: the cold cathode tube lamp having any of the fourteenth to nineteenth structures; a first conductive member and a second conductive member; and a power supply device that supplies power to the cold cathode tube lamp through the first conductive member and the second conductive member.

According to such a structure, the cold cathode tube lamps can be lit up in parallel by being driven in parallel, thereby permitting downsizing, weight saving, and cost reduction to be achieved.

The lighting device for a display device having any of the seventh to thirteenth structures and the twentieth structure may be structured (hereinafter referred to as a twenty-first structure) so that as the cold cathode tube lamp, a plurality of cold cathode tube lamps are provided which are entirely or partially electrically connected together in parallel.

According to such a structure, the number of the power supply devices can be reduced, thereby permitting downsizing, the weight saving, and cost reduction to be achieved.

In the lighting device for a display device having any of the twenty one structures described above, the phase of a voltage applied to the first internal electrode of the cold cathode tube lamps connected together in parallel and the phase of a voltage applied to the second internal electrode thereof are inverted relative to each other by about 180 degrees.

According to such a structure, the luminance gradient due to a leak current flowing for a conductor (for example, a metallic casing of the lighting device for a display device) near the power lines connected together in parallel becomes bilaterally-symmetric, thereby permitting improvement in the lighting quality. Moreover, according to such a structure, when the lighting device for a display device described above is mounted in a display unit, a net voltage that has an influence on a display element (for example, a display element of a liquid crystal display panel) near the power lines connected together in parallel actually becomes zero, thus permitting canceling noise at the display element attributable to the lighting device for a display device.

To achieve the advantages described above, a display device according to another preferred embodiment of the present invention is so structured as to include the lighting device for a display device having any of the seventh to thirteenth and the twentieth to twenty-second structures.

According to such a structure, the cold cathode tube lamps can be lit up in parallel by being driven in parallel, thereby permitting downsizing, the weight saving, and cost reduction to be achieved.

According to various preferred embodiments of the present invention, a circuit including a cold cathode tube lamp that is fed with power from a first conductive member and a second conductive member provided outside in a mounted state; the first conductive member; and the second conductive member, or a circuit including only the cold cathode tube lamp has an equivalent circuit thereof serving as a serially connected body in which a capacitor is connected to at least one end of a resistor whose resistance value nonlinearly decreases in accordance with an increase in current, and the circuit has a nonlinear positive impedance. Therefore, the cold cathode tube lamps can be lit up in parallel by being driven in parallel.

These and other features, elements, steps, characteristics and advantages of the present invention will become more apparent from the following detailed description of preferred embodiments thereof with reference to the drawings.

FIGS. 19A, 19B, 19C, 19D, 19E, and 19F are diagrams showing modified examples of the cold cathode tube lamp according to a preferred embodiment of the present invention.

FIGS. 20A, 20B, 20C, 20D, and 20E are diagrams showing modified examples of the cold cathode tube lamp according to a preferred embodiment of the present invention.

Figure 21:
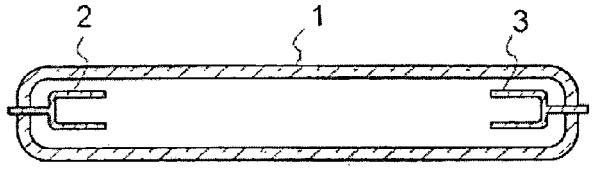
FIG.21 PRIOR ART

FIG. 21 is a schematic sectional view of a conventional cold cathode tube lamp.

Figure 22:
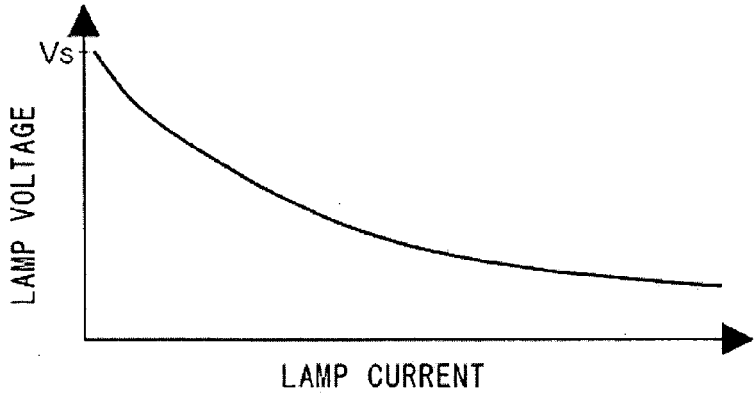
FIG.22 PRIOR ART

FIG. 22 is a diagram showing a V-I characteristic of the conventional cold cathode tube lamp shown in FIG. 21.

Figure 23:
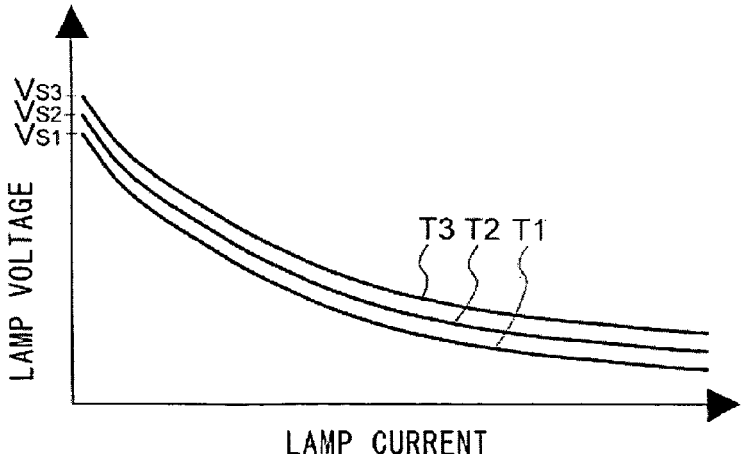
FIG.23 PRIOR ART

FIG. 23 is a diagram showing V-I characteristics of a plurality of conventional cold cathode tube lamps.

Figure 24:
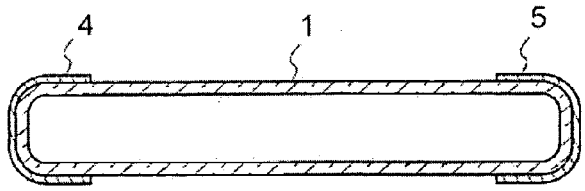
FIG.24 PRIOR ART

FIG. 24 is a schematic sectional view of an external electrode fluorescent lamp.

Figure 25:
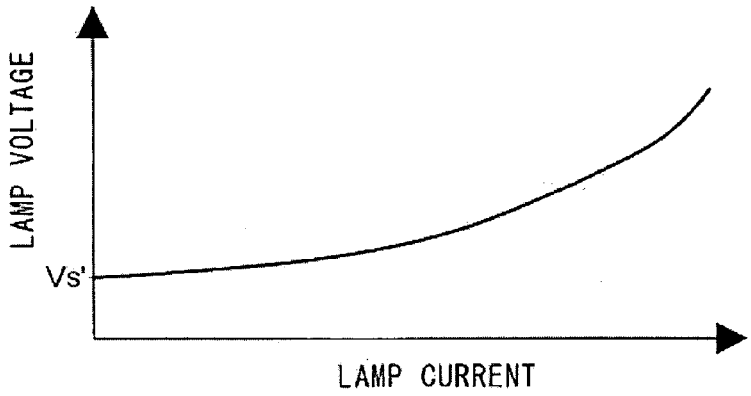
FIG.25 PRIOR ART

FIG. 25 is a diagram showing a V-I characteristic of the external electrode fluorescent lamp shown in FIG. 24.

Figure 26:
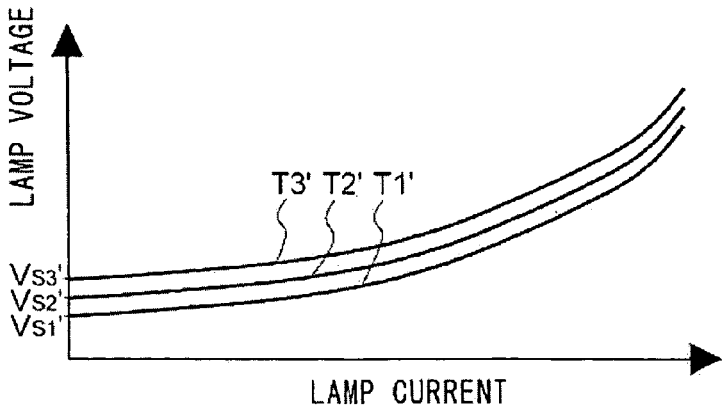
FIG.26 PRIOR ART

FIG. 26 is a diagram showing V-I characteristics of a plurality of external electrode fluorescent lamps.

DETAILED DESCRIPTION OF PREFERRED EMBODIMENTS

Hereinafter, preferred embodiments of the present invention will be described with reference to the drawings. Since the inner structure (including those enclosed) of a cold cathode tube lamp according to the present invention is not an essential part of the present invention, various known structures, arrangements and arts of the cold cathode tube lamp are applicable and thus it is omitted from the detailed description.

Figure 1:
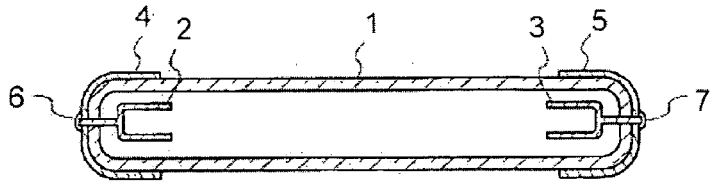
FIG. 1 is a schematic sectional view of a cold cathode tube lamp according to a first preferred embodiment of the present invention.

First, a first preferred embodiment of the present invention will be described. FIG. 1 is a schematic sectional view of a cold cathode tube lamp according to the first preferred embodiment of the present invention. In FIG. 1, portions which are the same as those shown in FIG. 21 are provided with the same numerals and are thus omitted from the detailed description. The cold cathode tube lamp shown in FIG. 1 is preferably constructed by providing external electrodes 4 and 5 at the end portions of the glass tube 1 of the conventional cold cathode tube lamp shown in FIG. 21 and then by soldering together a projection of an internal electrode 2 and the external electrode 4 with a solder 6 and soldering together a projection of an internal electrode 3 and the external electrode 5 with a solder 7. Specific preferred embodiments of the external electrodes 4 and 5 include metal paste, metal foil, metal cap, and other suitable material. If the electrical connection between the projection of the internal electrode 2 and the external electrode 4 and the electrical connection between the projection of the internal electrode 3 and the external electrode 5 are provided satisfactorily, the solders 6 and 7 may be omitted.

A lighting device for a display device according to the first preferred embodiment of the present invention preferably includes the cold cathode tube lamp shown in FIG. 1, a lighting unit, and an optical sheet, and is structured so that the cold cathode tube lamp shown in FIG. 1 is fitted to a holding jig provided at the front of the lighting unit and so that the front of the lighting unit fitted with the cold cathode tube lamp shown in FIG. 1 is covered by the optical sheet.

Figure 2A:
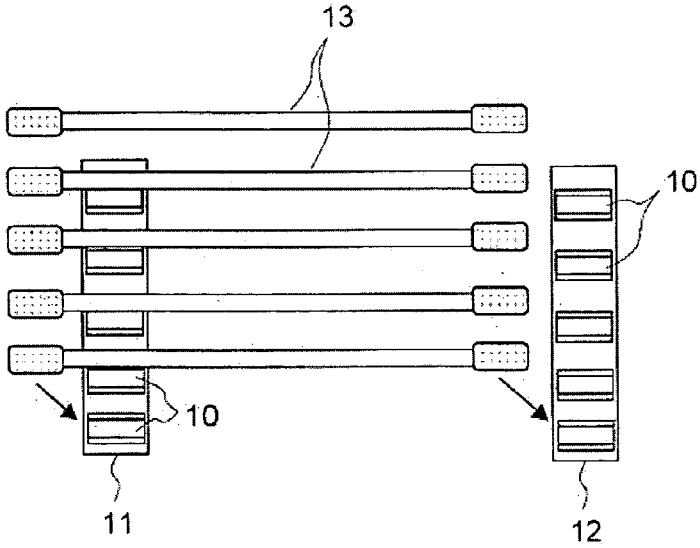
FIGS. 2A and 2B are diagrams showing how the cold cathode tube lamp according to the first preferred embodiment of the present invention is fitted to a holding jig.
Figure 2B:
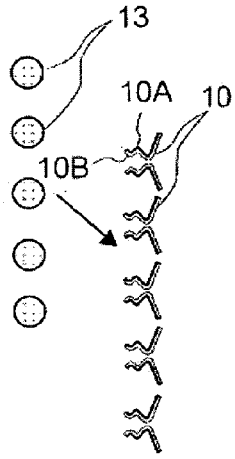

Now, FIGS. 2A and 2B show how the cold cathode tube lamp shown in FIG. 1 is fitted to the holding jig described above. FIG. 2A is an elevation view, and FIG. 2B is a side view. At the front of the lighting unit described above, a plurality of pairs of the holding jigs 10 are provided, and, at the back of the lighting unit, one power supply device, not shown, is provided. The power supply device described above outputs an alternating voltage of several tens of kHz. The holding jigs 10 provided at a front-side left edge portion 11 of the lighting unit described above are commonly connected together and then connected to one end of the power supply device described above. The holding jigs 10 provided at a front-side right edge portion 12 of the lighting unit are commonly connected together to so as to be connected to the other end of the power supply device. The holding jig 10 preferably includes a resilient metal member 10A and an insulating layer 10B, and clips the external electrodes of the cold cathode tube lamp shown in FIG. 1 under the influence of the resilient characteristic of the resilient metal member 10A. Such a structure permits connection between the cold cathode tube lamp shown in FIG. 1 and the power supply device described above without use of a harness (also referred to as a lead wire) and a connector.

When the cold cathode tube lamp 13 shown in FIG. 1 (hereinafter also referred to as "cold cathode tube lamp 13") is fitted to the holding jig 10, a capacitor is defined by the external electrode of the cold cathode tube lamp 13 and the holding jig 10, and a circuit composed of the holding jig 10 and the cold cathode tube lamp 13 clipped by the holding jig 10 has an equivalent circuit thereof serving as a serially connected body in which a capacitor is connected to the both ends of a resistor whose resistance value non-linearly decreases in accordance with an increase in current, and the circuit has a non-linear positive impedance characteristic, as is the case with the external electrode fluorescent lamp shown in FIG. 24. Therefore, even when a plurality of cold cathode tube lamps 13 are driven in parallel, all the cold cathode tube lamps 13 light up. In addition, since the internal electrode and the external electrode of the cold cathode tube lamp 13 are directly connected together, there is placed, between the resistance and the capacitor of the equivalent circuit described above, no parasitic capacitor and the like formed between the harness (also called lead wire) and a conductive casing of the lighting unit described above, thereby making it easier to suppress variations in the lamp current among the different cold cathode tube lamps 13.

In the cold cathode tube lamp 13, charged particles do not hit against the inner wall of the glass tube opposing the external electrodes, so that there is no risk, which exists in the external electrode fluorescent lamp, that a pinhole is formed in the glass tube. In the cold cathode tube lamp 13, the internal electrodes are spattered by being hit by the charged particles. Since the internal electrodes are at the same potential, like a lightning conductor, the charged particles reach a section near the discharge region of the internal electrodes to spatter them. Since the section near the discharge region of the internal electrodes varies during the course of spattering, concentrated spattering which occurs in the external electrode fluorescent lamp shown in FIG. 24 does not occur. Consequently, the life of the lamp is determined by the physical size of the internal electrode.

Figure 3:
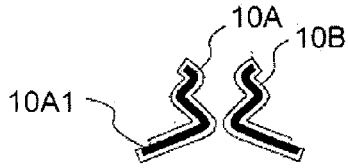
FIG. 3 is a diagram showing a modified example of the holding jig included in a lighting device for a display device according to the first preferred embodiment of the present invention.

It is preferable that the insulating layer 10B of the holding jig 10 be arranged so that the resilient metal member 10A and the external electrode of the cold cathode tube lamp 13 do not directly contact each other. However, in terms of preventing discharge between the external electrode of the cold cathode tube lamp 13 and the holding jig 10, it is preferable that, as shown in FIG. 3, the insulating layer 10B be disposed on the full surface of the resilient metal body 10A excluding an exposed portion 10A1 required for the connection to power supply device.

Alternatively, instead of the holding jig 10, even by forming in the lightning unit a conductive member which does not contact the external electrodes of the cold cathode tube lamp 13 and further by providing in the lighting unit a holding portion for holding the cold cathode tube lamp 13 so that the external electrode of the cold cathode tube lamp 13 and the conductive member defines a capacitor, a circuit composed of the cold cathode tube lamp 13 and the conductive member can be provided with a non-linear positive impedance characteristic, so that a plurality of cold cathode tube lamps 13 can be driven in parallel to be lit up in parallel. However, this causes a problem that the inter-electrode distance of the capacitor defined by the external electrode of the cold cathode tube lamp 13 and the conductive member described above becomes unstable and also causes a problem that there is a higher possibility that discharge will occur between the external electrode of the cold cathode tube lamp 13 and the conductive member. Thus, it is preferable to use holding jig 10.

Figure 4:
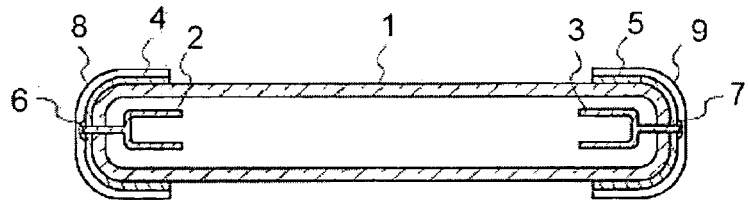
FIG. 4 is a schematic sectional view of a cold cathode tube lamp according to a second preferred embodiment of the present invention.

Next, a second preferred embodiment of the present invention will be described. FIG. 4 is a schematic sectional view of a cold cathode tube lamp according to the second preferred embodiment of the present invention. In FIG. 4, portions which are the same as those shown in FIG. 1 are provided with the same numerals and are thus omitted from the detailed description. The cold cathode tube lamp shown in FIG. 4 is preferably constructed by disposing insulating layers 8 and 9 on the external electrodes of the cold cathode tube lamp shown in FIG. 1. If the electrical connection between the projection of the internal electrode 2 and the external electrode 4 and the electrical connection between the projection of the internal electrode 3 and the external electrode 5 are provided satisfactorily, the solders 6 and 7 may be omitted.

A lighting device for a display device according to the second preferred embodiment of the present invention includes the cold cathode tube lamp shown in FIG. 4, a lighting unit, and an optical sheet, and is structured so that the cold cathode tube lamp shown in FIG. 4 is fitted to a holding jig provided at the front of the lighting unit and so that the front of the lighting unit fitted with the cold cathode tube lamp shown in FIG. 4 is covered by the optical sheet.

Figure 5A:
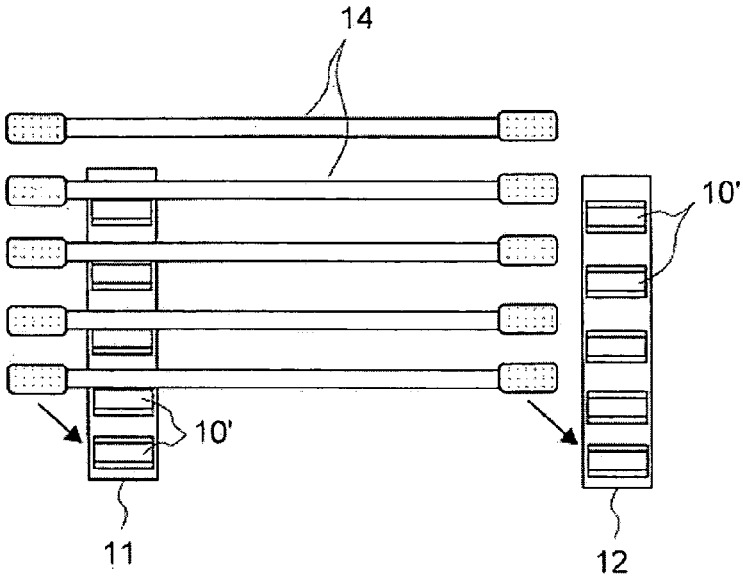
FIGS. 5A and 5B are diagrams showing how the cold cathode tube lamp according to the second preferred embodiment of the present invention is fitted to a holding jig.
Figure 5B:
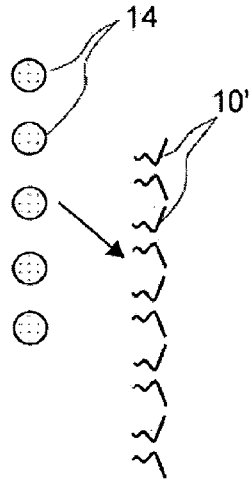

Now, FIGS. 5A and 5B show how the cold cathode tube lamp shown in FIG. 4 is fitted to the holding jig described above. FIG. 5A is an elevation view, and FIG. 5B is a side view. Portions in FIGS. 5A and 5B which are the same as those in FIGS. 2A and 2B are provided with the same numerals.

At the front of the lighting unit described above, a plurality of pairs of holding jigs 10' are provided, and, at the back of the lighting unit, one power supply device, not shown, is provided. The power supply device described above outputs an alternating voltage of several tens of kHz. The holding jigs 10' provided at a front-side left edge portion 11 of the lighting unit described above are commonly connected together and then connected to one end of the power supply device described above. The holding jigs 10' provided at a front-side right edge portion 12 of the lighting unit are commonly connect together to so as to be connected to the other end of the power supply device. Each of the holding jigs 10' is preferably composed of a resilient metal member (for example, spring steel), and clips the external electrodes of the cold cathode tube lamp shown in FIG. 4 under the influence of the resilient characteristic of the resilient metal member. Such a structure permits connection between the cold cathode tube lamp shown in FIG. 4 and the power supply device described above without use of a harness (also referred to as lead wire) and a connector.

When the cold cathode tube lamp 14 shown in FIG. 4 (hereinafter also referred to as "cold cathode tube lamp 14") is fitted to the holding jig 10', a capacitor is defined by the external electrode of the cold cathode tube lamp 14 and the holding jig 10', and a circuit composed of the holding jig 10' and the cold cathode tube lamp 14 clipped by the holding jig 10' has an equivalent circuit thereof serving as a serially connected body in which a capacitor is connected to the both ends of a resistor whose resistance value non-linearly decreases in accordance with an increase in current, and the circuit has a non-linear positive impedance characteristic, as is the case with the external electrode fluorescent lamp shown in FIG. 24. Therefore, even when a plurality of cold cathode tube lamps 14 are driven in parallel, all the cold cathode tube lamps 14 light up. In addition, since the internal electrode and the external electrode of the cold cathode tube lamp 14 are directly connected together, there is placed, between the resistance and the capacitor of the equivalent circuit described above, no parasitic capacitor and the like formed between the harness (also called lead wire) and a conductive casing of the lighting unit described above, thereby making it easier to suppress a variation in the lamp current among the different cold cathode tube lamps 14.

In the cold cathode tube lamp 14, charged particles do not hit against the inner wall of the glass tube opposing the external electrodes, so that there is no risk, which exists in the external electrode fluorescent lamp, that a pinhole is formed in the glass tube. In the cold cathode tube lamp 14, the internal electrodes are spattered by being hit by the charged particles. Since the internal electrodes are at the same potential, like a lightning conductor, the charged particles reach a section near the discharge region of the internal electrodes to spatter them. Since the section near the discharge region of the internal electrodes varies during the course of spattering, concentrated spattering which occurs in the external electrode fluorescent lamp shown in FIG. 24 does not occur. Consequently, the life of the lamp is determined by the physical size of the internal electrode.

Figure 6:
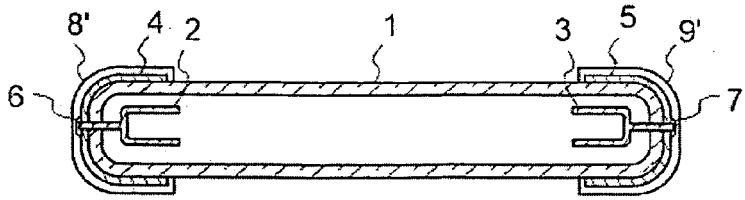
FIG. 6 is a diagram showing a modified example of the cold cathode tube lamp according to the second preferred embodiment of the present invention.

It is preferable that the insulating layer of the cold cathode tube lamp 14 be arranged so that the holding jig 10' and the external electrode of cold cathode tube lamp 14 do not directly contact each other. However, in terms of preventing discharge between the external electrode of the cold cathode tube lamp 14 and the holding jig 10', and especially in terms of preventing creeping discharge from occurring at the external electrode edge portion of the cold cathode tube lamp 14, it is preferable in the second preferred embodiment of the present invention that the cold cathode tube lamp shown in FIG. 6 be used instead of the cold cathode tube lamp shown in FIG. 4. Portions in FIG. 6 which are the same as those in FIG. 4 are provided with the same numerals and thus are omitted from the detailed description. In the cold cathode tube lamp shown in FIG. 6, the entire external electrode 4 is covered by the glass tube 1 and the insulating layer 8' and the entire external electrode 5 is covered by the glass tube 1 and the insulating layer 9'.

Next, the third preferred embodiment of the present invention will be described. The cold cathode tube lamp according to the third preferred embodiment of the present invention preferably has the same structure as that of the cold cathode tube lamp according to the second preferred embodiment of the present invention.

A lighting device for a display device according to the third preferred embodiment of the present invention includes the cold cathode tube lamp according to the third preferred embodiment, a lighting unit, and an optical sheet, and is structured so that the cold cathode tube lamp according to the third preferred embodiment of the present invention is fitted to a holding jig provided at the front of the lighting unit and so that the front of the lighting unit fitted with the cold cathode tube lamp according to the third preferred embodiment of the present invention is covered by the optical sheet.

Figure 7A:
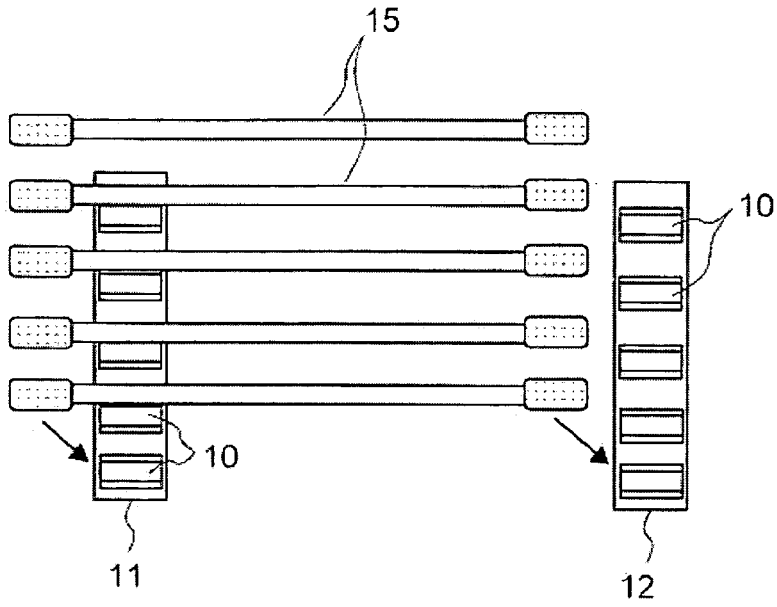
FIGS. 7A and 7B are diagrams showing how a cold cathode tube lamp according to a third preferred embodiment of the present invention is fitted to a holding jig.
Figure 7B:
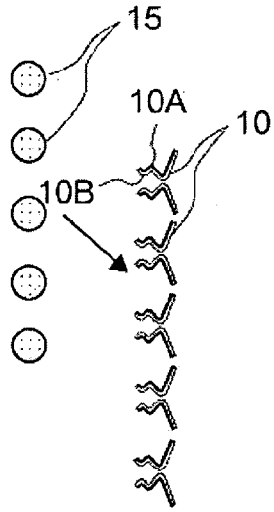

Now, FIGS. 7A and 7B show how the cold cathode tube lamp according to the third preferred embodiment of the present invention is fitted to the holding jig described above. FIG. 7A is an elevation view, and FIG. 7B is a side view. Portions in FIGS. 7A and 7B which are the same as those in FIGS. 2A and 2B are provided with the same numerals.

At the front of the lighting unit described above, a plurality of pairs of holding jigs 10 are provided, and, at the back of the lighting unit, one power supply device, not shown, is provided. The power supply device described above outputs an alternating voltage of several tens of kHz. The holding jigs 10 provided at a front-side left edge portion 11 of the lighting unit described above are commonly connected together and then connected to one end of the power supply device described above. The holding jigs 10 provided at a front-side right edge portion 12 of the lighting unit are commonly connect together and then connected to the other end of the power supply device. The holding jig 10 preferably includes a resilient metal member 10A and an insulating layer 10B, and clips the external electrodes of the cold cathode tube lamp according to the third preferred embodiment of the present invention under the influence of the resilient characteristic of the resilient metal member 10A. Such a structure permits connection between the cold cathode tube lamp according to the third preferred embodiment of the present invention and the power supply device described above without use of a harness (also referred to as lead wire) and a connector.

When the cold cathode tube lamp 15 according to the third preferred embodiment of the present invention (hereinafter also referred to as "cold cathode tube lamp 15") is fitted to the holding jig 10, a capacitor is defined by the external electrode of the cold cathode tube lamp 15 and the holding jig 10, and a circuit composed of the holding jig 10 and the cold cathode tube lamp 15 clipped by the holding jig 10 has an equivalent circuit thereof serving as a serially connected body in which a capacitor is connected to the both ends of a resistor whose resistance value non-linearly decreases in accordance with an increase in current, and the circuit has a non-linear positive impedance characteristic, as is the case with the external electrode fluorescent lamp shown in FIG. 24. Therefore, even when a plurality of cold cathode tube lamps 15 are driven in parallel, all the cold cathode tube lamps 15 light up. In addition, since the internal electrode and the external electrode of the cold cathode tube lamp 15 are directly connected together, there is placed, between the resistance and the capacitor of the equivalent circuit described above, no parasitic capacitor and the like formed between the harness (also called lead wire) and a conductive casing of the lighting unit described above, thereby making it easier to suppress a variation in the lamp current among the different cold cathode tube lamps 15.

In the cold cathode tube lamp 15, charged particles do not hit against the inner wall of the glass tube opposing the external electrodes, so that there is no risk, which exists in the external electrode fluorescent lamp, that a pinhole is formed in the glass tube. In the cold cathode tube lamp 15, the internal electrodes are spattered by being hit by the charged particles. Since the internal electrodes are at the same potential, like a lightning conductor, the charged particles reach a section near the discharge region of the internal electrodes to spatter them. Since the section near the discharge region of the internal electrodes varies during the course of spattering, concentrated spattering which occurs in the external electrode fluorescent lamp shown in FIG. 24 does not occur. Consequently, the life of the lamp is determined by the physical size of the internal electrode.

Further, the lighting device for a display device according to the third preferred embodiment of the present invention has insulating layers disposed both on the external electrodes of the cold cathode tube lamp 15 and the holding jig 10. Thus, compared to lighting devices for a display device according to the first and second preferred embodiments of the present invention, the reliability of a capacitor defined by the external electrodes of the cold cathode tube lamp 15 and the holding jig 10, and thus reliability of the lighting device for a display device improve.

It is preferable that the insulating layer 10B of the holding jig 10 be arranged so that the resilient metal member 10A and the external electrode of the cold cathode tube lamp 15 do not directly contact each other. However, in terms of preventing discharge between the external electrode of the cold cathode tube lamp 15 and the holding jig 10, it is preferable that, as shown in FIG. 3, the insulating layer 10B be disposed on the entire surface of the resilient metal body 10A excluding an exposed portion 10A1 required for the connection to power supply device.

Next, the fourth preferred embodiment of the present invention will be described. In the first to third preferred embodiments of the present invention described above, a capacitor is defined by the external electrode of the cold cathode tube lamp and the holding jig. However, it is difficult to stabilize the capacitor defined by the external electrode of the cold cathode tube lamp and the holding jig since the holding jig is located outside the cold cathode tube lamp and thus its position is not fixed with respect to the cold cathode tube lamp. Such a problem can be solved by adopting the fourth preferred embodiment of the present invention.

Figure 8:
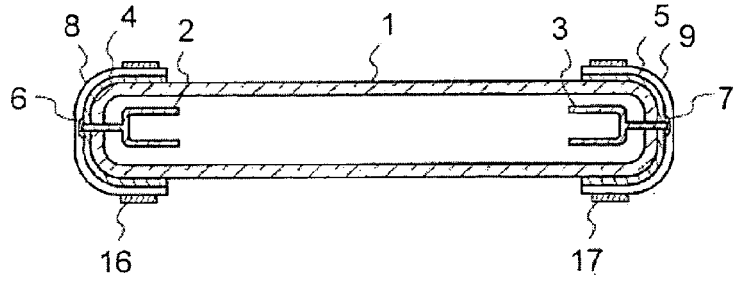
FIG. 8 is a schematic sectional view of a cold cathode tube lamp according to a fourth preferred embodiment of the present invention.

FIG. 8 is a schematic sectional view of the cold cathode tube lamp according to the fourth preferred embodiment of the present invention. In FIG. 8, portions which are the same as those shown in FIG. 4 are provided with the same numerals and thus are omitted from the detailed description. The cold cathode tube lamp shown in FIG. 8 is structured by providing opposite electrodes 16 and 17 having a substantially circular band shape on the insulating layers 8 and 9 of the cold cathode tube lamp shown in FIG. 4. If the electrical connection between the projection of the internal electrode 2 and the external electrode 4 and the electrical connection between the projection of the internal electrode 3 and the external electrode 5 are provided satisfactorily, the solders 6 and 7 may be omitted.

A lighting device for a display device according to the fourth preferred embodiment of the present invention includes the cold cathode tube lamp shown in FIG. 8, a lighting unit, and an optical sheet, and is structured so that the cold cathode tube lamp shown in FIG. 8 is fitted to a holding jig provided at the front of the lighting unit and so that the front of the lighting unit fitted with the cold cathode tube lamp shown in FIG. 8 is covered by the optical sheet.

Figure 9A:
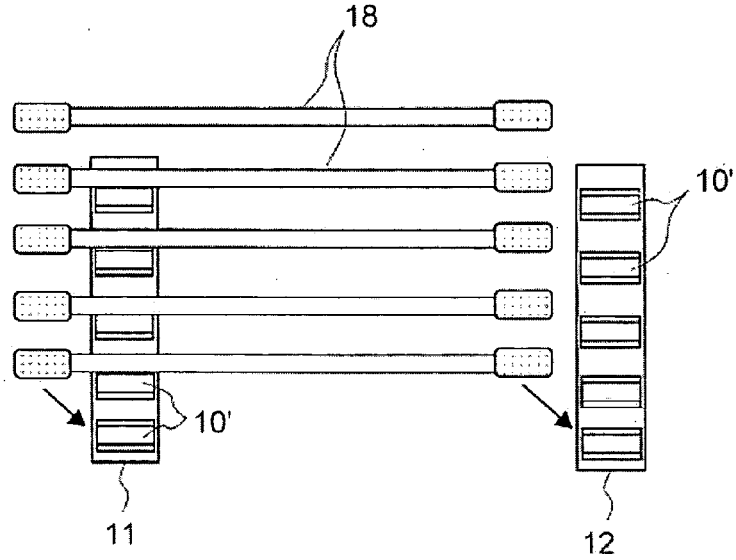
FIGS. 9A and 9B are diagrams showing how the cold cathode tube lamp according to the fourth preferred embodiment of the present invention is fitted to a holding jig.
Figure 9B:
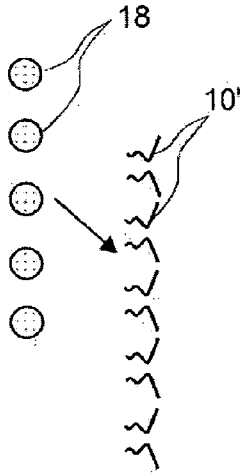

Now, FIGS. 9A and 9B show how the cold cathode tube lamp shown in FIG. 8 is fitted to the holding jig described above. FIG. 9A is an elevation view, and FIG. 9B is a side view. Portions in FIGS. 9A and 9B which are the same as those in FIGS. 5A and 5B are provided with the same numerals.

At the front of the lighting unit described above, a plurality of pairs of holding jigs 10' are provided, and, at the back of the lighting unit, one power supply device, not shown, is provided. The power supply device described above outputs an alternating voltage of several tens of kHz. The holding jigs 10' provided at a front-side left edge portion 11 of the lighting unit described above are commonly connected together and then connected to one end of the power supply device described above. The holding jigs 10' provided at a front-side right edge portion 12 of the lighting unit are commonly connected together and then connected to the other end of the power supply device. Each of the holding jigs 10' preferably includes a resilient metal member (for example, spring steel), and clips the external electrodes of the cold cathode tube lamp shown in FIG. 8 under the influence of the resilient characteristic of the resilient metal member. Opposite electrodes 16 and 17 of the cold cathode tube lamp 18 shown in FIG. 8 and the holding jig 10' are electrically connected together. Such a structure permits connection between the cold cathode tube lamp shown in FIG. 8 and the power supply device described above without use of a harness (also referred to as lead wire) and a connector.

The cold cathode tube lamp 18 shown in FIG. 8 (hereinafter also referred to as "cold cathode tube lamp 18") has a capacitor defined by the external electrode 4 and the opposite electrode 16 thereof and a capacitor defined by the external electrode 5 and the opposite electrode 17 thereof, and thus has an equivalent circuit thereof serving as a serially connected body in which a capacitor is connected to the both ends of a resistor whose resistance value non-linearly decreases in accordance with an increase in current, and the circuit has a non-linear positive impedance characteristic, as is the case with the external electrode fluorescent lamp shown in FIG. 24. Therefore, even when a plurality of cold cathode tube lamps 18 are driven in parallel, all the cold cathode tube lamps 18 light up. In addition, since the internal electrode and the external electrode of the cold cathode tube lamp 18 are directly connected together, there is placed, between the resistance and the capacitor of the equivalent circuit described above, no parasitic capacitor and the like formed between the harness (also called lead wire) and a conductive casing of the lighting unit described above, thereby making it easier to suppress a variation in the lamp current among the different cold cathode tube lamps 18.

In the cold cathode tube lamp 18, charged particles do not hit against the inner wall of the glass tube opposing the external electrodes, so that there is no risk, which exists in the external electrode florescent lamp, that a pinhole is formed in the glass tube. In the cold cathode tube lamp 18, the internal electrodes are spattered by being hit by the charged particles. Since the internal electrodes are at the same potential, like a lightning conductor, the charged particles reach a section near the discharge region of the internal electrodes to spatter them. Since the section near the discharge region of the internal electrodes varies during the course of spattering, concentrated spattering which occurs in the external electrode fluorescent lamp shown in FIG. 24 does not occur. Consequently, the life of the lamp is determined by the physical size of the internal electrode.

Further, the cold cathode tube lamp 18 has the capacitor defined by the external electrode 4 and the opposite electrode 16 thereof and the capacitor defined by the external electrode 5 and the opposite electrode 17 thereof, and the position of the opposite electrodes 16 and 17 are fixed with respect to the external electrodes 4 and 5, respectively. This permits stabilization of the capacitor defined by the external electrode 4 and the opposite electrode 16 of the cold cathode tube lamp 18 and the capacitor defined by the external electrode 5 and the opposite electrode 17 of the cold cathode tube lamp 18.

Figure 10:
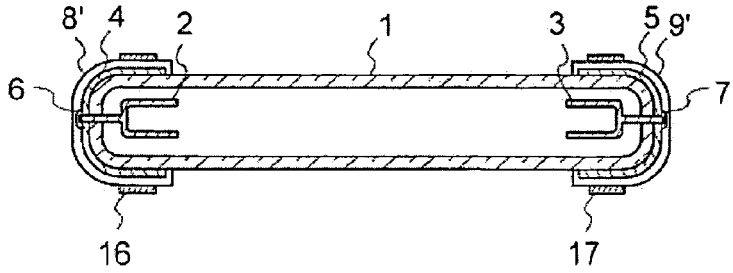
FIG. 10 is a diagram showing a modified example of the cold cathode tube lamp according to the fourth preferred embodiment the present invention.

It is preferable that the insulating layers of the cold cathode tube lamp 18 be arranged so that the external electrode and the opposite electrode of the cold cathode tube lamp 18 do not directly contact each other. However, in terms of preventing discharge between the external electrode and the opposite electrode of the cold cathode tube lamp 18, and especially in terms of preventing creeping discharge at the external electrode edge portion of the cold cathode tube lamp 18, it is preferable in the fourth preferred embodiment of the present invention that the cold cathode tube lamp shown in FIG. 10 be used instead of the cold cathode tube lamp shown in FIG. 8. Portions in FIG. 10 which are the same as those in FIG. 8 are provided with the same numerals and thus are omitted from the detailed description. In the cold cathode tube lamp shown in FIG. 10, the entire external electrode 4 is covered by the glass tube 1 and the insulating layer 8' and the entire external electrode 5 is covered by the glass tube 1 and the insulating layer 9'.

Figure 11A:
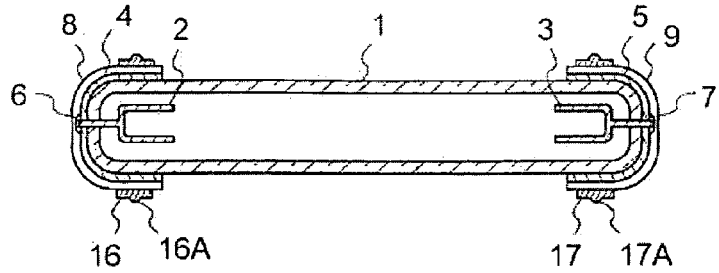
FIGS. 11A and 11B are diagrams showing modified examples of the cold cathode tube lamp according to the fourth preferred embodiment of the present invention.
Figure 11B:
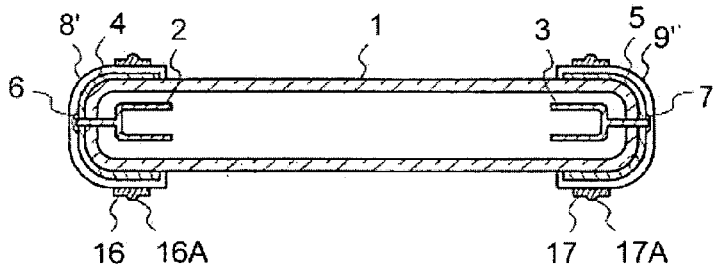

It is preferable that the opposite electrodes 16 and 17 of the cold cathode tube lamp 18 shown in FIG. 8 and the holding jig 10' be electrically connected together, and in order to ensure the electrical connection between the opposite electrodes 16 and 17 of the cold cathode tube lamp 18 and the holding jigs 10', it is desirable that, as shown in FIGS. 11A and 11B, the opposite electrodes 16 and 17 having the substantially circular band shape be provided with projections 16A and 17A also having a substantially circular shape.

Figure 12:
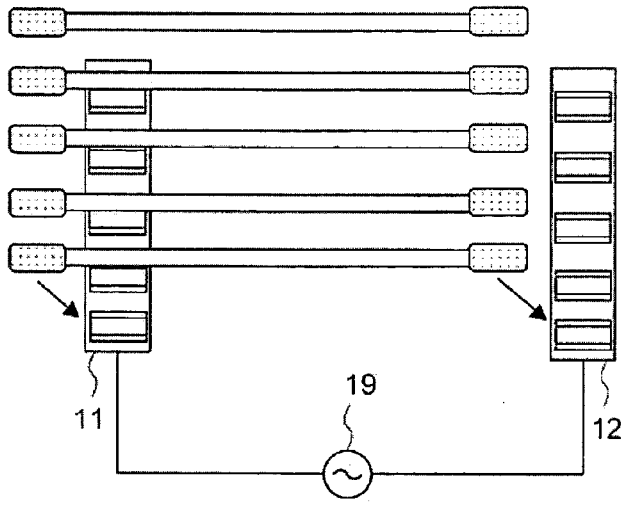
FIG. 12 is a diagram showing an arrangement example of a power supply device in a lighting device for a display device according to a preferred embodiment of the present invention.
Figure 13:
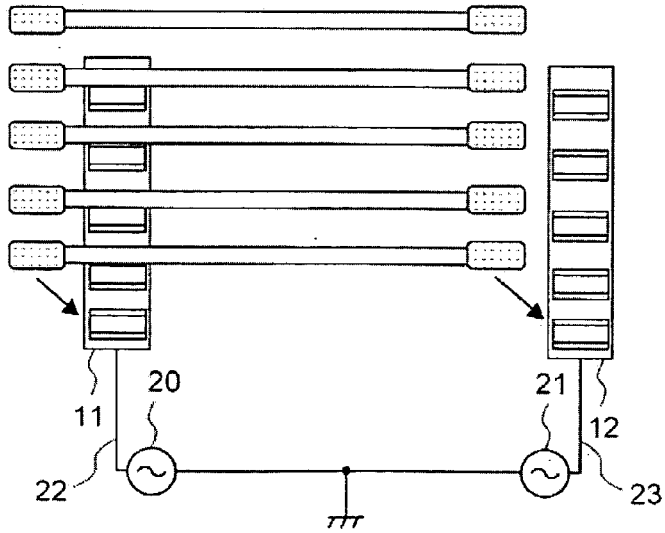
FIG. 13 is a diagram showing an arrangement example of a power supply device in a lighting device for a display device according to a preferred embodiment of the present invention.

Next, arrangement examples of a power supply device in a lighting device for a display device according to various preferred embodiments of the present invention will be described. In the arrangement example of the power supply device shown in FIG. 12, the holding jigs provided at the front-side left edge portion 11 of the lighting unit are commonly connected together and then connected to one end of the power supply device 19, and the holding jigs provided at the front-side right edge portion 12 of the lighting unit are connected together and then connected to the other end of the power supply device 19. The power supply device 19 is a power supply device that is provided on the back surface of the lighting unit and that outputs an alternating voltage of several tens of kHz. On the other hand, in the arrangement example of the power supply device shown in FIG. 13, the holding jigs provided at the front-side left edge portion 11 of the lighting unit are commonly connected together and then connected to one end of the power supply device 20, and the holding jigs provided at the front-side right edge portion 12 of the lighting unit are connected together and then connected to one end of the power supply device 21. The other end of the power supply device 20 and the other end of the power supply device 21 are connected to a ground. The power supply devices 20 and 21 are power supply devices that are provided on the back surface of the lighting unit and that output an alternating voltage of several tens of kHz. The arrangement example of the power supply devices shown in FIG. 13 permits reductions in the routing of high voltage lines 22 and 23 that transmit high voltage, thus permitting stabilization of the lamp current and a reduction in power loss to be achieved.

In the lighting device for a display device according to a preferred embodiment of the present invention, it is desirable, in terms of reducing the number of power supply devices, that one power supply device drive all the cold cathode tube lamps in parallel. However, depending on balance between the capacity of the power supply device and the number of cold cathode tube lamps, instead of driving all the cold cathode tube lamps in parallel by one power supply device, the cold cathode tube lamps may be divided into a plurality of groups, and a power supply device may be provided, for each group, which drives the cold cathode tube lamps in the group in parallel.

The phase of a voltage applied to one internal electrode side of the cold cathode tube lamps electrically connected in parallel and the phase of a voltage applied to the other internal electrode side thereof may be inverted relative to each other by about 180 degrees. According to such a structure, the luminance gradient due to a leak current flowing for a conductor (for example, a metallic casing of the lighting device for a display device) near the power lines connected together in parallel becomes bilaterally-symmetric, thereby permitting an improvement in the lighting quality. Moreover, according to such a structure, when the lighting device for a display device described above is mounted in a display unit, a net voltage that has an influence on a display element (for example, a display element of a liquid crystal display panel) near the power lines connected together in parallel actually becomes zero, thus permitting canceling noise at the display element attributable to the lighting device for a display device.

Figure 14:
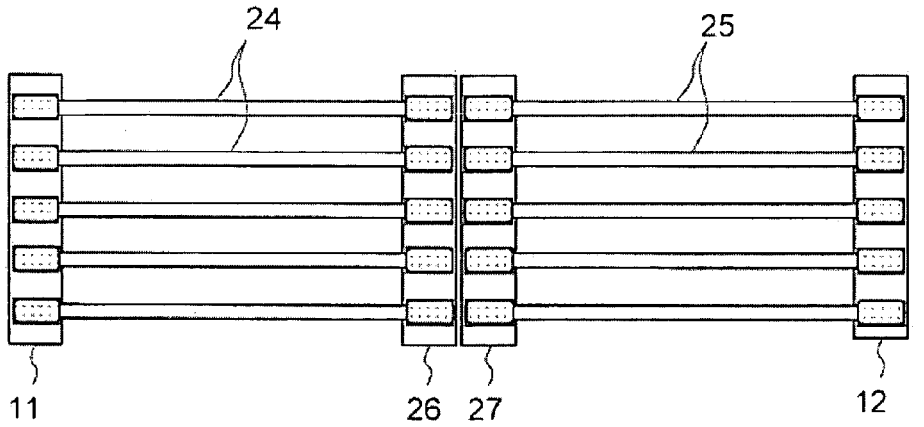
FIG. 14 is a diagram showing an arrangement example of a cold cathode electrode tube lamp and a holding jig in a lighting device for a display device according to a preferred embodiment of the present invention.
Figure 15:
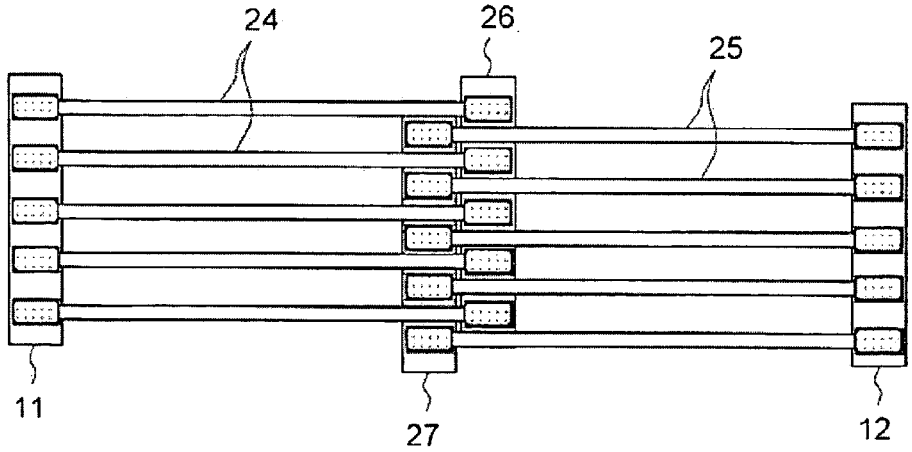
FIG. 15 is a diagram showing an arrangement example of the cold cathode electrode tube lamp and the holding jig in the lighting device for a display device according to a preferred embodiment of the present invention.

When the lighting device for a display according to a preferred embodiment of the present invention is applied to a display device whose display screen size exceeds 37V type, in order to control the discharge start voltage of the cold cathode tube lamp at a low level, it is desirable, for example, that the cold cathode tube lamps and the holding jigs in the lighting device for a display device according to various preferred embodiments of the present invention be arranged as shown in FIG. 14 or 15.

In the arrangement example of the cold cathode tube lamps and the holding jigs shown in FIG. 14, the front-side left end portions of the front-side left cold cathode tube lamps 24 are respectively clipped by the holding jigs provided at a front-side left edge portion 11; the front-side right end portions of the front-side left cold cathode tube lamps 24 are respectively clipped by the holding jigs provided at a first central portion 26; the front-side right end portions of the front-side right cold cathode tube lamps 25 are respectively clipped by the holding jigs provided at a front-side right edge portion 12; and the front-side left end portions of the front-side right cold cathode tube lamps 25 are respectively clipped by the holding jigs provided at a second central portion 27.

In an arrangement example of the cold cathode tube lamps and the holding jigs shown in FIG. 15, the front-side left end portions of the front-side left cold cathode tube lamps 24 are respectively clipped by the holding jigs provided at a front-side left edge portion 11; the front-side right end portions of the front-side left cold cathode tube lamps 24 are respectively clipped by the holding jigs provided at a first central portion 26; the front-side right end portions of the front-side right cold cathode tube lamps 25 are respectively clipped by the holding jigs provided at a front-side right edge portion 12; and the front-side left end portions of the front-side right cold cathode tube lamps 25 are respectively clipped by the holding jigs provided at a second central portion 27. A light emitting area of the front-side right cold cathode tube lamps 25 is positioned on the first central portion 26, and a light emitting area of the front-side left cold cathode tube lamps 24 is positioned on the second central part 27. The arrangement example of the cold cathode tube lamps and the holding jigs shown in FIG. 15 can suppress a reduction in the amount of light emission at the first central portion 26 and the second central portion 27 more than the arrangement example of the cold cathode tube lamps and the holding jigs shown in FIG. 14 can.

In the arrangement example of the cold cathode tube lamps and the holding jigs shown in FIG. 14 and the arrangement example of the cold cathode tube lamps and the holding jigs shown in FIG. 15, it is preferable that a material high in reflectivity be used for the surface layer at the front-side right end portions (non light emission area) of the front-side left cold cathode tube lamps 24 and the surface layer at the front-side left end portions (non light emission area) of the front-side right cold cathode tube lamps 25. Further, since the use of a white-colored material permits reducing non-uniform light emission at the first central portion 26 and second central portion 27 areas, it is further preferable that a white-colored material high in reflectivity be used.

Next, arrangement examples of the power supply devices in the arrangement example of the cold cathode tube lamps and the holding jigs shown in FIG. 14 and the arrangement example of the cold cathode tube lamps and the holding jigs shown in FIG. 15 will be described.

Figure 16:
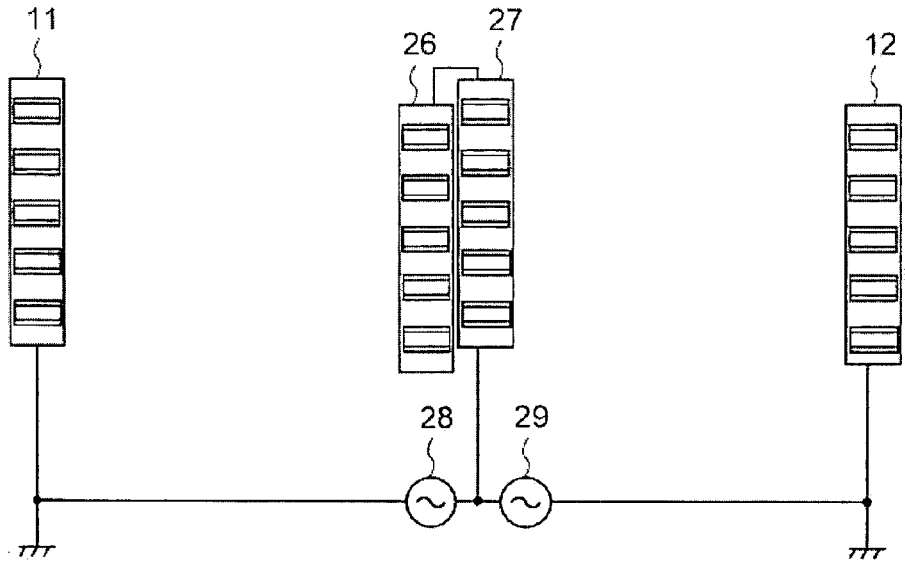
FIG. 16 is a diagram showing an arrangement example of a power supply device in the arrangement example of the cold cathode tube lamp and the holding jig shown in FIG. 14 and in the arrangement example of the cold cathode tube lamp and the holding jig shown in FIG. 15.

In the arrangement example of the power supply devices shown in FIG. 16, the holding jigs provided at the front-side left edge portion 11 of the lighting unit are commonly connected together and then connected to one end of the power supply device 28 and a ground. The holding jigs provided at the front-side right edge portion 12 of the lighting unit are commonly connected together and then connected to one end of the power supply device 29 and a ground. Then, the holding jigs provided at the first central portion 26 of the lighting unit and the holding jigs provided at the second central portion 27 of the lighting unit are commonly connected together and then connected to the other end of the power supply device 28 and the other end of the power supply device 29. The power supply devices 28 and 29 are power supply devices that are provided on the back surface of the lighting unit and that output an alternating voltage of several tens of kHz. From the other end of the power supply device 28 and the other end of the power supply device 29, voltages that are in phase with each other are outputted.

Figure 17:
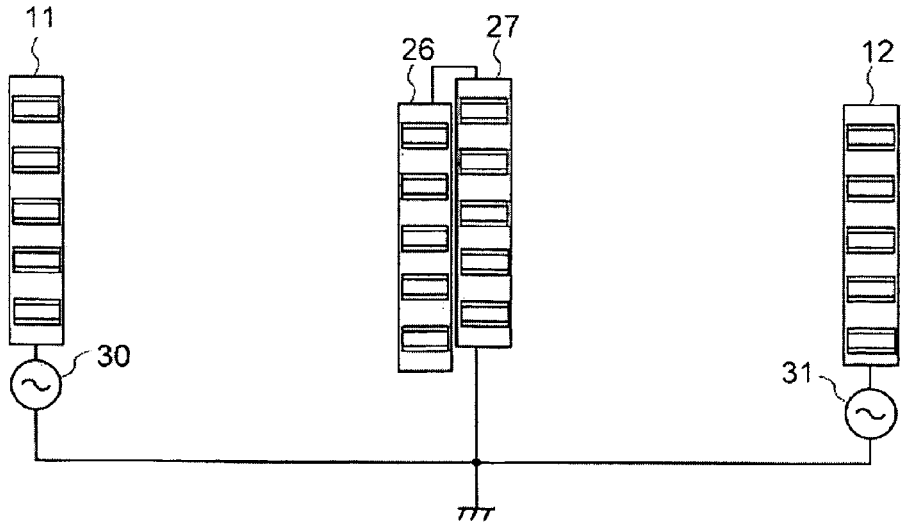
FIG. 17 is a diagram showing an arrangement example of the power supply device in the arrangement example of the cold cathode tube lamp and the holding jig shown in FIG. 14 and in the arrangement example of the cold cathode tube lamp and the holding jig shown in FIG. 15.

In an arrangement example of the power supply devices shown in FIG. 17, the holding jigs provided at the front-side left edge portion 11 of the lighting unit are commonly connected together and then connected to one end of the power supply device 30. The holding jigs provided at the front-side right edge portion 12 of the lighting unit are commonly connected together and then connected to one end of the power supply device 31. The holding jigs provided at the first central portion 26 of the lighting unit and the holding jigs provided the second central portion 27 of the lighting unit are commonly connected together and then connected to the other end of the power supply device 30, the other end of the power supply device 31, and a ground. The power supply devices 30 and 31 are power supply devices that are provided on the back surface of the lighting unit and that output an alternating voltage of several tens of kHz. From one end of the power supply device 30 and one end of the power supply device 31, voltages that are in phase with each other or in opposite phase to each other are outputted.

Figure 18:
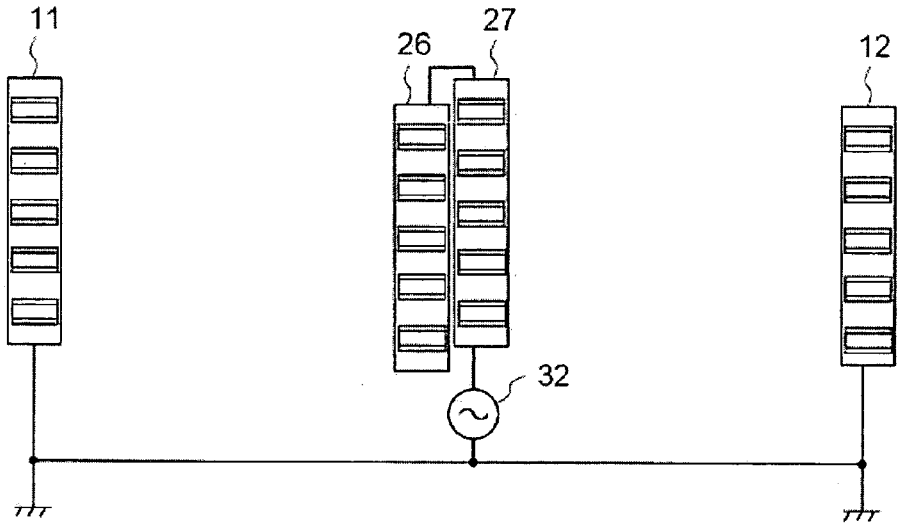
FIG. 18 is a diagram showing an arrangement example of the power supply device in the arrangement example of the cold cathode tube lamp and the holding jig shown in FIG. 14 and in the arrangement example of the cold cathode tube lamp and the holding jig shown in FIG. 15.
Figure 19A:
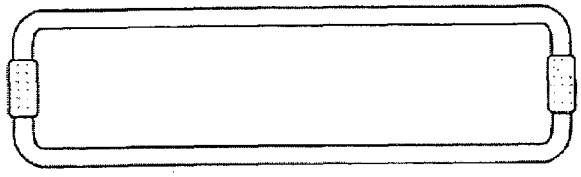
Figure 19B:
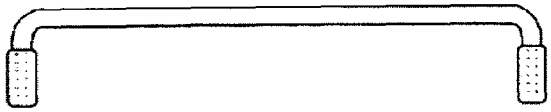
Figure 19C:
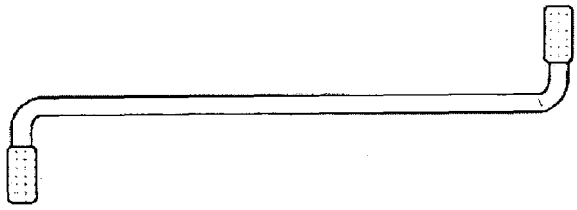
Figure 19D:
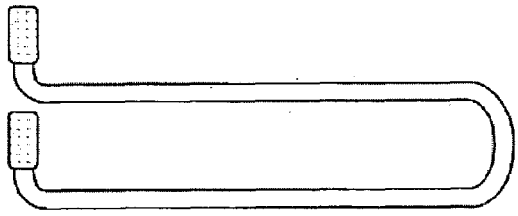
Figure 19E:
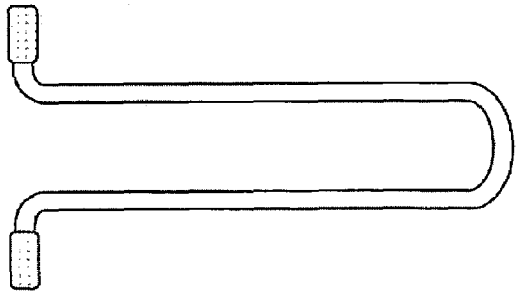
Figure 19F:
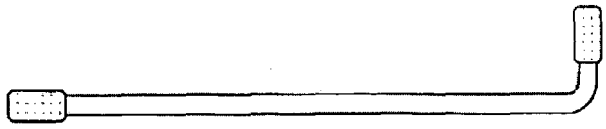

In the arrangement example of the power supply device shown in FIG. 18, the holding jigs provided at the front-side left edge portion 11 of the lighting unit are commonly connected together and then connected to one end of the power supply device 32 and a ground. The holding jigs provided at the front-side right edge portion 12 of the lighting unit are commonly connected together and then connected to one end of the power supply device 32 and a ground. The holding jigs provided at the first central portion 26 of the lighting unit and the holding jigs provided at the second central portion 27 of the lighting unit are commonly connected together and then connected to the other end of the power supply device 32. The power supply device 32 is a power supply device that is provided on the back surface of the lighting unit and that outputs an alternating voltage of several tens of kHz.

Any of the arrangement examples of the power supply devices shown in FIGS. 16 to 18 can reduce the routing of power lines that transmit high voltage, thus permitting achieving stabilization of the lamp current and a reduction in power loss.

In the cold cathode tube lamp according to a preferred embodiment of the present invention, as shown in FIGS. 19A to 19F, part or all of the tube axes of external electrode portions (portions where external electrodes of the glass tube are formed) may be oriented substantially perpendicular to the tube axis of a light emission portion in the main disposition direction. Consequently, in order to achieve an increase in the electrostatic capacitance of a capacitor defined by the external electrode of the cold cathode tube lamp according to preferred embodiments of the present invention and the holding jig or the conductive member, even when the area of the external electrode of the cold cathode tube lamp according to preferred embodiments of the present invention is increased, an increase in the width dimension of the frame portion of the lighting device for a display device can be suppressed.

Figure 20A:
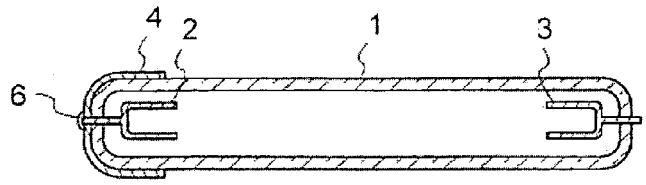
Figure 20B:
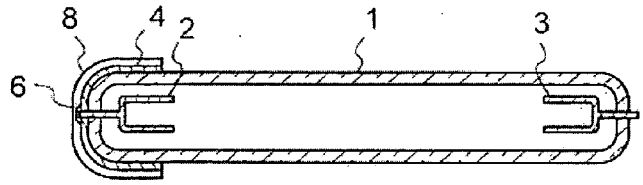
Figure 20C:
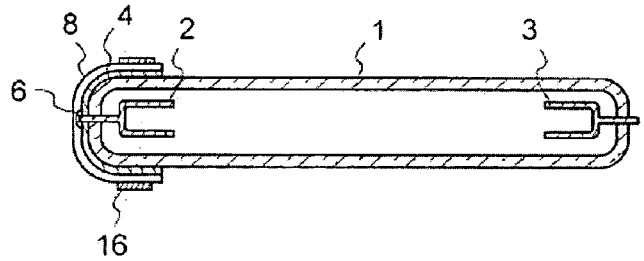
Figure 20D:
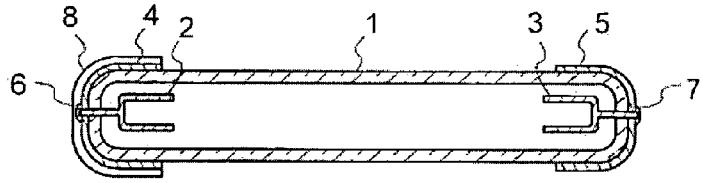
Figure 20E:
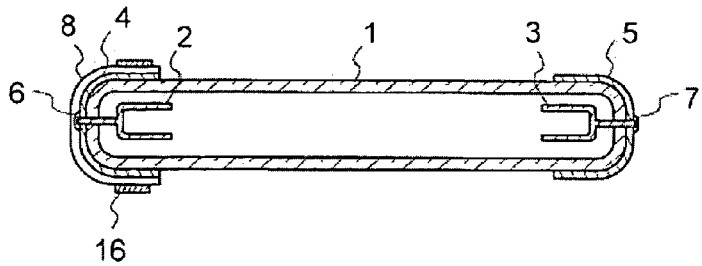

In various preferred embodiments described above, two external electrodes are preferably provided to the cold cathode tube lamp, but the cold cathode tube lamp according to the present invention may include only one external electrode since a nonlinear positive impedance characteristic can be provided even with only one external electrode. For example, when the cold cathode tube lamps according to various preferred embodiments of the present invention shown in FIGS. 1, 4, and 8 are so modified as to include only one external electrode, they become as shown in FIGS. 20A, 20B, and 20C, respectively. Note, however, that with the structures as shown in FIGS. 20A, 20B, and 20C, a lamp end portion on the internal electrode 3 is connected to a power supply circuit via a harness (also called lead wire) and a connector, which involves labor in fitting and detaching the cold cathode lamp tube. Moreover, in the second to fourth preferred embodiments described above, the cold cathode tube lamp according to the present invention is preferably provided with two insulating layers. Since a nonlinear positive impedance characteristic can be provided even with only one insulating layer, the cold cathode tube lamp according to the present invention may include only one insulating layer. For example, when the cold cathode tube lamps according to the present invention shown in FIGS. 4 and 8 are so modified as to include only one insulating layer, they become as shown in FIGS. 20D and 20E. With the structure as shown in FIGS. 20D and 20E, as is the case with a lamp end portion on the internal electrode 2 side, to a lamp end portion on the internal electrode 3 side, a preferred embodiment is applicable in which under the influence of a resilient characteristic of a holding jig of a resilient metal member (for example, a spring steel), the holding jig clips the external electrode, thus making it easier to fit and detach the cold cathode tube lamp.

A display unit according to a preferred embodiment of the present invention includes the lighting device for a display device according to various preferred embodiments of the present invention described above and a display panel. Specific preferred embodiments of the display unit according to the present invention include, for example, a transmissive liquid crystal display device including the lighting device for a display device according to the third preferred embodiment of the present invention as a back light unit, on the front surface of which a liquid crystal display panel is provided.

The cold cathode tube lamp according to various preferred embodiments of the present invention can be used as a light source provided in various devices including a light source provided in a lighting device for a display device.

While the present invention has been described with reference to what are presently considered to be the preferred embodiments, it is to be understood that the invention is not limited to the disclosed preferred embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A cold cathode tube lamp that is fed with power from a first conductive member and a second conductive member when mounted with the first conductive member and the second conductive member in a mounted state, the cold cathode tube lamp comprising:

an insulating tube formed of an insulating material that passes light;

a first internal electrode provided inside the insulating tube;

a second internal electrode provided inside the insulating tube; and a first external electrode provided outside the insulating tube and connected to the first internal electrode so as to be provided with a same potential as a potential of the first internal electrode; wherein the first external electrode is arranged to be capacitively coupled to the first conductive member when in the mounted state; and the first external electrode includes a portion provided on an outer circumferential surface of the insulating tube that is located at a different position than where the first external electrode is connected to the first internal electrode.

2. The cold cathode tube lamp according to claim 1, further comprising a second external electrode provided outside the insulating tube and connected to the second internal electrode so as to be provided with a same potential as a potential of the second internal electrode; wherein the second external electrode is arranged to be capacitively coupled with the second conductive member when in the mounted state.

3. The cold cathode tube lamp according to claim 1, further comprising a first insulator arranged to be located between the first conductive member and the first external electrode when in the mounted state.

4. The cold cathode tube lamp according to claim 2, further comprising:

a first insulator arranged to be located between the first conductive member and the first external electrode when in the mounted state; and a second insulator arranged to be located between the second conductive member and the second external electrode when in the mounted state.

5. The cold cathode tube lamp according to claim 3, wherein the first external electrode is provided on the outside of the insulating tube and the entire exterior surface of the first external electrode is covered by the first insulator.

6. The cold cathode tube lamp according to claim 4, wherein:

the first external electrode is provided on the outside of the insulating tube and the entire exterior surface of the first external electrode is covered by the first insulator; and the second external electrode is provided on the outside of the insulating tube and the entire exterior surface of the second external electrode is covered by the second insulator.

7. A cold cathode tube lamp that is fed with power from a first conductive member and a second conductive member when mounted with the first conductive member and the second conductive member in a mounted state, the cold cathode tube lamp comprising:

an insulating tube formed of an insulating material that passes light;

a first internal electrode provided inside the insulating tube;

a second internal electrode provided inside the insulating tube;

a first external electrode provided outside the insulating tube and connected to the first internal electrode so as to be provided with a same potential as a potential of the first internal electrode;

a first opposite electrode opposing the first external electrode; and a first insulator provided between the first opposite electrode and the first external electrode; wherein when in the mounted state, the first opposite electrode is arranged to be electrically connected to the first conductive member; and the first external electrode includes a portion provided on an outer circumferential surface of the insulating tube that is located at a different position than where the first external electrode is connected to the first internal electrode.

8. The cold cathode tube lamp according to claim 7, further comprising:

a second external electrode provided outside the insulating tube and connected to the second internal electrode so as to be provided with a same potential as a potential of the second internal electrode;

a second opposite electrode opposing the second external electrode; and a second insulator provided between the first opposite electrode and the first external electrode; wherein the second insulator is provided between the second opposite electrode and the second external electrode; and the second opposite electrode is arranged to be electrically connected to the second conductive member when in the mounted state.

9. The cold cathode tube lamp according to claim 7, wherein the first external electrode is provided on the outside of the insulating tube and the entire exterior surface of the first external electrode is covered by the first insulator.

10. The cold cathode tube lamp according to claim 8, wherein:

the first external electrode is provided on the outside of the insulating tube and the entire exterior surface of the first external electrode is covered by the first insulator; and the second external electrode is provided on the outside of the insulating tube and the entire exterior surface of the second external electrode is covered by the second insulator.

11. The cold cathode tube lamp according to claim 7, wherein:

the first opposite electrode has a projection; and the projection of the first opposite electrode is arranged to be electrically connected to the first conductive member when in the mounted state.

12. The cold cathode tube lamp according to claim 8, wherein:

the first opposite electrode has a projection;

the projection of the first opposite electrode is arranged to be electrically connected to the first conductive member when in the mounted state;

the second opposite electrode has a projection; and the projection of the second opposite electrode is arranged to be electrically connected to the second conductive member when in the mounted state.

13. The cold cathode tube lamp according to claim 9, wherein:

the first opposite electrode has a projection; and the projection of the first opposite electrode is arranged to be electrically connected to the first conductive member when in the mounted state.

14. The cold cathode tube lamp according to claim 10, wherein:

the first opposite electrode has a projection;

the projection of the first opposite electrode is arranged to be electrically connected to the first conductive member when in the mounted state;

the second opposite electrode has a projection; and the projection of the second opposite electrode is arranged to be electrically connected to the second conductive member when in the mounted state.

15. A lighting device for a display device comprising:

the cold cathode tube lamp according to claim 1 that is in the mounted state with the first conductive member and the second conductive member; and a power supply device that supplies power to the cold cathode tube lamp through the first conductive member and the second conductive member.

16. The lighting device for a display device according to claim 15, wherein, as the cold cathode tube lamp, a plurality of cold cathode tube lamps are provided, the plurality of cold cathode tubes being entirely or partially electrically connected together in parallel.

17. The lighting device for a display device according to claim 16, wherein a phase of a voltage applied to the first internal electrode of the cold cathode tube lamps connected together in parallel and a phase of a voltage applied to the second internal electrode thereof are inverted relative to each other by about 180 degrees.

18. A display device comprising the lighting device for a display device according to claim 15.

* * * * *

UNITED STATES PATENT AND TRADEMARK OFFICE

CERTIFICATE OF CORRECTION

PATENT NO. : 7,638,945 B2
APPLICATION NO. : 11/380742
DATED : December 29, 2009
INVENTOR(S) : Yoshiki Takata It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 827 days.

Signed and Sealed this

Twenty-first Day of December, 2010

David J. Kappos

David J. Kappos
*Director of the United States Patent and Trademark Office*